United States Patent [19]

Maisel

[11] 4,178,780

[45] Dec. 18, 1979

[54] NEEDLE BED FOR FLAT KNITTING MACHINE

[76] Inventor: Hans Maisel, Mistelbach, Fed. Rep. of Germany

[21] Appl. No.: 916,682

[22] Filed: Jun. 19, 1978

[30] Foreign Application Priority Data

Jun. 23, 1977 [DE] Fed. Rep. of Germany ..... 2728223

[51] Int. Cl.[2] ..... D04B 15/00

[52] U.S. Cl. ..... 66/115

[58] Field of Search ..... 66/115, 114, 106

[56] References Cited

U.S. PATENT DOCUMENTS

| | | | |
|---|---|---|---|
| 2,623,372 | 12/1952 | Zielinski | 66/115 |
| 3,509,737 | 5/1970 | Shima | 66/115 |

FOREIGN PATENT DOCUMENTS

| | | | |
|---|---|---|---|
| 988526 | 8/1951 | France | 66/115 |
| 449166 | 6/1949 | Italy | 66/115 |
| 461696 | 2/1951 | Italy | 66/115 |

*Primary Examiner*—Ronald Feldbaum
*Attorney, Agent, or Firm*—Allison C. Collard; Thomas M. Galgano

[57] ABSTRACT

A needle bed for flat knitting machines is provided wherein the needle bed is assembled from a plurality of firmly compressed, plate-like webs arranged in a regularly alternating manner so that webs having the smaller height and forming the base of the needle bed grooves, alternate with plates having a greater height and forming the needle bed web surfaces. The plurality of webs are pressed together with the aid of tightening means to form a solid pack. The pack is inserted, with the aid of at least one longitudinal mounting groove, into a trough shaped sheet steel section which extends in the longitudinal direction of the needle bed. The pack and section are firmly clamped together and the cavities between the webs and the steel sheet section are filled with a synthetic resin based metal glue.

9 Claims, 3 Drawing Figures

NEEDLE BED FOR FLAT KNITTING MACHINE

The present invention concerns improvements in or relating to needle beds for flat knitting machines.

This invention is concerned with a flat needle bed for knitting machines which comprises a large number of parallel grooves designed for the slidable support of latch needles, spring needles, or slide needles pushed out one after the other by cams on cam-boxes driven in the longitudinal direction of the needle bed. The speed at which the needles are operated and the extremely high rate of reversal of their directions of motion, combined with the stresses applied by the knitting threads, lead to considerable needle bed wear, especially in the zones of the knock-over verges and knockover surfaces, so that highly alloyed high quality steels have to be used for their manufacture. Apart from this it is necessary to use special machines and cutting heads for cutting the grooves and both the manufacturing costs and manufacturing labour are therefore extremely high. In an attempt to lower this cost component needlebeds have been designed where the use of high quality steel was limited to the manufacture of the needle bed webs which were punched out of sheet steel. The cutting work was thus reduced to the manufacture of the grooves in the needle bed which were required to accommodate the punched, plate-like, needle bed webs. Although needle beds composed of these parts are less expensive, they suffer losses in their rigidity and stability as a result of cutting the grooves into which the needle bed webs are inserted; this means that they are unstable and in addition to this the web elements used under constantly changing loads, tend to work loose and thus cause idle time when repairing the machines.

It is an object of the present invention to obviate or mitigate the shortcomings outlined above and is less expensive to manufacture, the proportionate quantity of high grade steel used with the assembly being very moderate, and there being no need for using special machines and tool heads for the manufacture of the parts made of steel. Combined with a Jacquard attachment, the machine is very compact and stable.

According to the present invention there is provided a needle bed for flat knitting machines, wherein the needle bed is assembled from a plurality of firmly compressed, platelike webs arranged in a regularly alternating manner so that plates having the smaller height and forming the base of the needle bed grooves, alternate with plates having a greater height and forming the needle bed webs, said plurality of plates being pressed together with the aid of tightening means to form a solid pack inserted, with the aid of at least one longitudinal mounting groove into a trough shaped sheet steel section which extends in the longitudinal direction of the needle bed, the parts being firmly clamped together and the cavities between the plates and the steel sheet section being filled with a synthetic resin based metal glue.

An embodiment of the present invention will now be described by way of example only, reference being made to the accompanying drawings in which.

Figure 1:
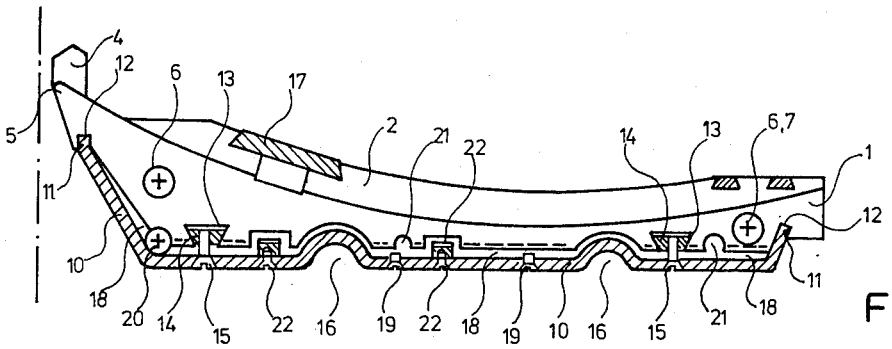
FIG. 1 is a cross-section through a horizontal needle bed, where both the needle bed grooves and the needles, are of arcuate form.

Components which serve the same functions are shown in the drawing with identical reference numbers so as to reduce the complexity of illustration to a minimum. As shown in the three FIGS. 1, 2, and 3, the needle bed is assembled from a large number of plates constituting the needle bed webs, which are punched out of sheet steel and on assembly firmly pressed together. Smaller plates 1 provide the bases of the needle bed grooves along which the needles 3 slide. Higher plates 2, which are similarly punched out of sheet steel provide the needle bed web surfaces, their front ends constituting the knock-over verges 4, while the knock-over surfaces are formed by the front edges of the lower plates 1. At least two interaligning bores 6, which extend through all plates 1 and 2, accommodate suitable fixing elements in the form of tightening bolts 7 which project at either end into corresponding bores **6*a* in cast steel cheeks 8 which constitute the two ends of the needle bed. By tightening the nut 9, all plates 1 and 2 are pressed together so that a solid block of plates is formed. This block consisting of the assembled plates 1, 2 is inserted into a trough shaped base 10 made of a section of sheet steel and clamped on to the latter. For assembly, locating edges 11 are provided at the front and rear ends of the sheet steel section 10, the front and rear ends of all plates 1, 2 forming corresponding fitting grooves 12. The underside of the plate assembly 1, 2 is provided with two dovetailed, aligning grooves 13 which extend in the longitudinal direction of the needle bed and accommodate two clamping bars of correspondingly dovetailed trapezoidal cross-section 14. With the aid of a set of draw-in bolts 15 inserted into the assembly on the underside of the sheet steel section 10 these clamping bars 14 and consequently the plate assembly 1, 2, are firmly clamped with the steel sheet section 10. The latter may be provided with a number of stiffening ribs 16 embossed into the steel section in the longitudinal direction of the needle bed. The higher plates 2 comprise dovetail shaped cut-outs punched through their upper edges in the longitudinal direction of the needle bed, into which a retaining bar 17 is inserted to prevent, in a known manner, the needles from jumping out of the needle bed groove. Cavities 18 formed between the lower edges of the plates 1, 2 and the inner surface of the steel sheet section 10 are filled with a resin-based metal glue to increase the stability and rigidity of the assembly, the glue being injected through sealable bores 19 in the steel section 10, and 20 in the two lateral cast steel cheeks 8. In order to enhance the bonding effect between the metal glue and the adjacent plates 1, 2 on the one hand and the internal surface of the steel section 10 on the other, the lower edges at least of some of the plates 1, 2 are provided with punched undercuts 21, and the internal surface of the steel section 10 may be provided with a number of hook shaped elements 22** mounted at any suitable positions to the surface so that the metal glue may accumulate behind said hook shaped elements.

Figure 2:
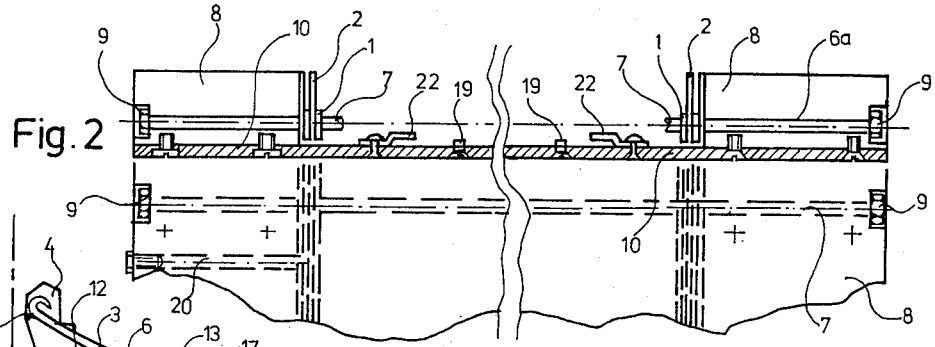
FIG. 2 is a longitudinal section through the needle bed of FIG. 1, part of it being a top view.
Figure 3:
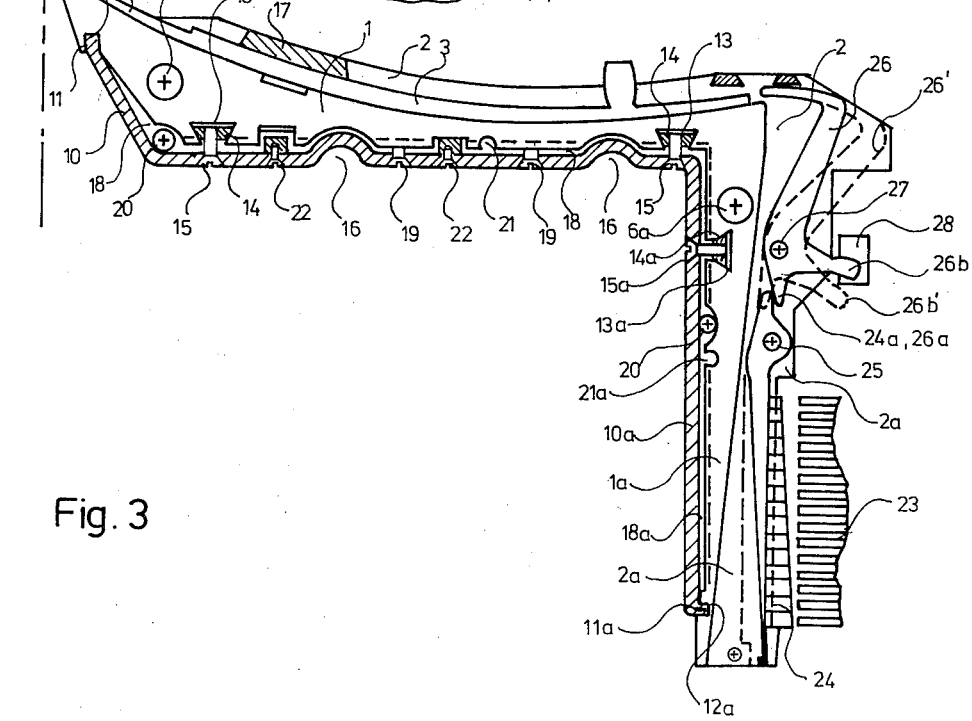
FIG. 3 is a cross-section through a needle bed similar to the one shown in FIG. 1 but having a pattern selector unit attached to it.

The upper horizontal part of the needle bed represented in FIG. 3 in cross-section corresponds substantially to the needle bed shown in FIG. 1. However, it comprises additionally a Jacquard selector unit which is shown at the right hand side of the illustration. For assembly, the steel section 10 extends substantially vertically downwards on the side which is remote from the knock-over surface 5, as indicated by reference 10*a*.

The plate assembly 1, 2 which has to correspond to the deflected part 10*a* of the steel section 10, is provided with substantially vertical legs or extensions 1*a* and 2*a*. In analogy with the embodiment shown in FIG. 1, these extensions 1*a* and 2*a* comprise bores 6*a* for a tightening bolt 7, a dove-tail shaped groove 13*a* into which is inserted a clamping bar 14*a*, and a set of draw-in bolts 15*a*, and there is also an undercut 21*a* punched into the plates. The lower edge of the rectangular steel sheet section 10 i.e. the edge 10*a*, comprises a fitting edge 11*a* which engages with a corresponding fitting groove 12*a* in the extensions 1*a*, 2*a*. The pattern selector unit incorporates control cams 23 which are merely indicated on the drawing. They interact with pattern sinkers 24 which are pivoted about bearings 25. A row of swivelling sinkers 26, pivoted at bearings 27, interact with dogs 24*a*, 26*a* on the sinkers in such a manner that a barrel shaped base 26*a* on the swivelling sinker 26 engages actively with cams indicated at 28. With the sinkers in the position of rest, that is to say when it disengages the cams 28, the sinkers assume the position indicated in broken lines and by reference number 26'. In this position the pivots 25 and 27 are located at a higher level, coinciding with the extensions 2*a* of the higher plates 2.

With the needle bed according to the invention the spacing of the needle bed grooves may be varied by using sheet steel of the desired thickness, the plates 1, 2 or 1*a*, 2*a* being punched out of the sheet steel with the aid of only one punching tool. The vertical downward deflection of the sheet steel section 10, 10*a* and the plates 1, 2 or 1*a*, 2*a* facilitates assembling the machine with a Jacquard pattern control unit at minimum floor space requirements, whereby as a result of the rectangular deflection the relation between the slide block and the bearings is especially favourable for incorporation of smaller cams. The additional advantages gained thereby are that the movements of needles and sinkers which, with known designs of knitting machines reciprocate in a sliding manner, have been changed into rotational, or rather swivelling motions, the pattern sinkers and the swivelling sinkers being suitably pivoted. Thus the carriage speed and the consequential rate of production have been considerably increased.

Design and construction of the needle bed according to the invention are particularly suitable for use on flat knitting machines where instead of being coordinated in the conventional manner with gable type straight needle beds and straight needles, the needle bed is located in a horizontal plane and comprises arcuate needle bed grooves and needles, the manufacture of arcuate grooves being extremely difficult and expensive when applying the conventional practice.

What we claim is:

1. A needle bed for flat knitting machines of the type having a needle bed including a plurality of firmly compressed, laminated, plate-like webs, which plurality of webs includes relatively short webs, each of which form the base of a needle bed groove and relatively tall webs, each of which form the needle bed web surfaces and which are arranged in a regularly alternate manner with said short webs, and said needle bed also including tightening means for pressing said plurality of webs together to form a solid pack, the improvement comprising:

said plurality of webs pressed together to form a solid pack having at least one longitudinal fitting groove formed therein; and a trough-shaped sheet steel section which extends in the longitudinal direction of said needle bed and in which said solid pack is inserted and firmly clamped thereto, said trough-shaped sheet steel section having at least one fitting edge configured for mating receipt within said fitting groove of said solid pack, said fitting edge being fitted within said fitting groove so as to at least partially aid in the secure clamping of said pack to said trough-shaped sheet steel section.

2. The needle bed according to claim 1, wherein said webs are punched out of steel sheeting and have at least two bores formed therethrough aligned in the longitudinal direction of the needle bed and wherein said tightening means includes two cast steel cheeks disposed at opposite ends of said needle bed and a pair of tightening bolts, each of which extend through one of the bores of said webs and is anchored in said cheeks.

3. The needle bed according to claim 1, wherein all of said webs are provided with at least one dove-tail shaped groove, all aligning in the longitudinal direction of the needle bed and wherein said needle bed additionally includes at least one clamping bar having a trapezoid cross-section which is received in said groove of said webs and at least one draw-in bolt for clamping said bar to said sheet steel section.

4. The needle bed according to claim 1, wherein at least some of said webs have at least one undercut punch-out on the sides adjacent to said sheet steel section to increase the bonding effect of said metal glue.

5. The needle bed according to claim 1, wherein hook-shaped elements are fixed to the internal surface of said steel sheet section to increase the bonding effect of the metal glue.

6. The needle bed according to claim 1, wherein said tall webs comprise at their upper edges and in aligning positions, cut-outs forming a groove into which a needle-retaining bar may be inserted.

7. The needle bed according to claim 1, wherein longitudinal stiffening ribs are impressed into said steel sheet section.

8. The needle bed according to claim 1, additionally including a Jacquard pattern control unit having pattern sinkers and swivelling stop rods which interact with needles for the bed, wherein said bed has a knock-over surface and said sheet steel section, extending in the longitudinal direction of the needle bed, is deflected, on the side remote from said knock-over surface, in a substantially vertical downward direction, wherein said webs are provided with corresonding deflected, substantially vertical extensions having a mounting groove in which the lower edge of the deflected portion of said section is engaged and wherein the extensions of said tall webs comprise bearing points for pivotably mounting said pattern sinkers and said swivelling stop rods.

9. The needle bed according to claim 1, wherein said webs and said section have cavities therebetween which are filled with a synthetic resin based metal glue.

* * * * *